US008689905B2

(12) United States Patent
Krueger et al.

(10) Patent No.: US 8,689,905 B2
(45) Date of Patent: Apr. 8, 2014

(54) DRILLING ASSEMBLY WITH STEERING UNIT INTEGRATED IN DRILLING MOTOR

(75) Inventors: Sven Krueger, Niedersachsen (DE); Michael Koppe, Niedersachsen (DE); Bernd Santelmann, Niedersachsen (DE); Thomas Kelch, Niedersachsen (DE); Niko Spreckelmeyer, Lower Saxony (DE); Olof Hummes, Northrhine-Westfalia (DE)

(73) Assignee: Baker Hughes Incorporated, Houston, TX (US)

( * ) Notice: Subject to any disclaimer, the term of this patent is extended or adjusted under 35 U.S.C. 154(b) by 538 days.

(21) Appl. No.: 12/952,764

(22) Filed: Nov. 23, 2010

(65) Prior Publication Data

US 2011/0120775 A1 May 26, 2011

Related U.S. Application Data

(60) Provisional application No. 61/264,159, filed on Nov. 24, 2009.

(51) Int. Cl.
*E21B 7/04* (2006.01)

(52) U.S. Cl.
USPC ..... 175/73

(58) Field of Classification Search
USPC ..... 175/61, 40, 76, 74, 75, 73, 81
See application file for complete search history.

(56) References Cited

U.S. PATENT DOCUMENTS

| | | | | |
|---|---|---|---|---|
| 5,924,499 | A * | 7/1999 | Birchak et al. | 175/40 |
| 6,206,108 | B1 * | 3/2001 | MacDonald et al. | 175/24 |
| 6,233,524 | B1 * | 5/2001 | Harrell et al. | 702/9 |
| 6,269,892 | B1 | 8/2001 | Boulton et al. | |
| 6,427,783 | B2 | 8/2002 | Krueger et al. | |
| 7,267,184 | B2 * | 9/2007 | Helms et al. | 175/76 |
| 7,383,897 | B2 * | 6/2008 | Moody et al. | 175/73 |
| 7,556,105 | B2 * | 7/2009 | Krueger | 175/45 |
| 8,011,452 | B2 * | 9/2011 | Downton | 175/76 |
| 2006/0021797 | A1 | 2/2006 | Krueger | |

* cited by examiner

*Primary Examiner* — Daniel P Stephenson
(74) *Attorney, Agent, or Firm* — Cantor Colburn LLP

(57) ABSTRACT

An apparatus for use in a wellbore is provided, which in one embodiment includes a drilling motor and a steering unit placed about a shaft between a lower section of a stator in the motor and a drill bit. The steering unit includes a substantially non-rotating member and a force application member on the non-rotating member configured to radially extend the force application member from the non-rotating member. In another embodiment, the steering unit may include, rotating member configured to rotate a drill bit, a steering member configured to orient the drill bit along a selected direction, a first steering device configured to orient the steering member in the wellbore, and a second steering device configured to maintain orientation of the steering member when drilling the wellbore.

20 Claims, 4 Drawing Sheets

DRILLING ASSEMBLY WITH STEERING UNIT INTEGRATED IN DRILLING MOTOR

CROSS REFERENCES TO RELATED APPLICATIONS

This application claims priority from the U.S. Provisional Patent Application having Ser. No. 61/264,159 filed Nov. 24, 2009.

BACKGROUND INFORMATION

1. Field of the Disclosure

This disclosure relates generally to drilling apparatus that includes a steering device for drilling deviated wellbores.

2. Background Art

Oil wells (also referred to as "wellbores" or "boreholes") are drilled with a drill string that includes a tubular member having a drilling assembly (also referred to as the "bottomhole assembly" or "BHA") at an end of the tubular member. The BHA typically includes devices and sensors that provide information relating to a variety of parameters relating to (i) drilling operations ("drilling parameters"); (ii) behavior of the BHA ("BHA parameters"); and (iii) parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, straight sections at an angle from the vertical, curved sections and horizontal sections through differing types of rock formations. To drill non-vertical sections of the borehole, a steering unit is often employed in the BHA. One type of a steering unit includes a number of force application members on a non-rotating sleeve. The force application members apply force on the wellbore wall to direct the drill bit along a desired path. It is desirable to provide such a a steering unit as close to the bit as practical to alter the drilling direction so that highly curved wellbore sections may be built with a relatively short curvature (or radius).

The present disclosure provides a BHA that may be utilized to drill short radius wellbores and further includes a variety of sensors that provide measurements for determining downhole parameters of interest.

SUMMARY

An apparatus for drilling a wellbore is provided that in one embodiment may include a drilling motor having a rotor inside a stator, the rotor including a shaft configured to be coupled to a drill bit, the stator having a lower section disposed around the shaft; and a steering unit placed about the shaft between the lower section of the stator and the drill bit, the steering unit including a substantially non-rotating member having a force application member configured to apply force on the wellbore.

The apparatus, in another embodiment, may include a rotating member for rotating a drill bit, a steering member placed outside the rotating member, the steering member including a selectable orientation, a first steering device configured to orient the steering member when the steering member is in the wellbore and a second steering device configured to maintain orientation of the steering member when drilling the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
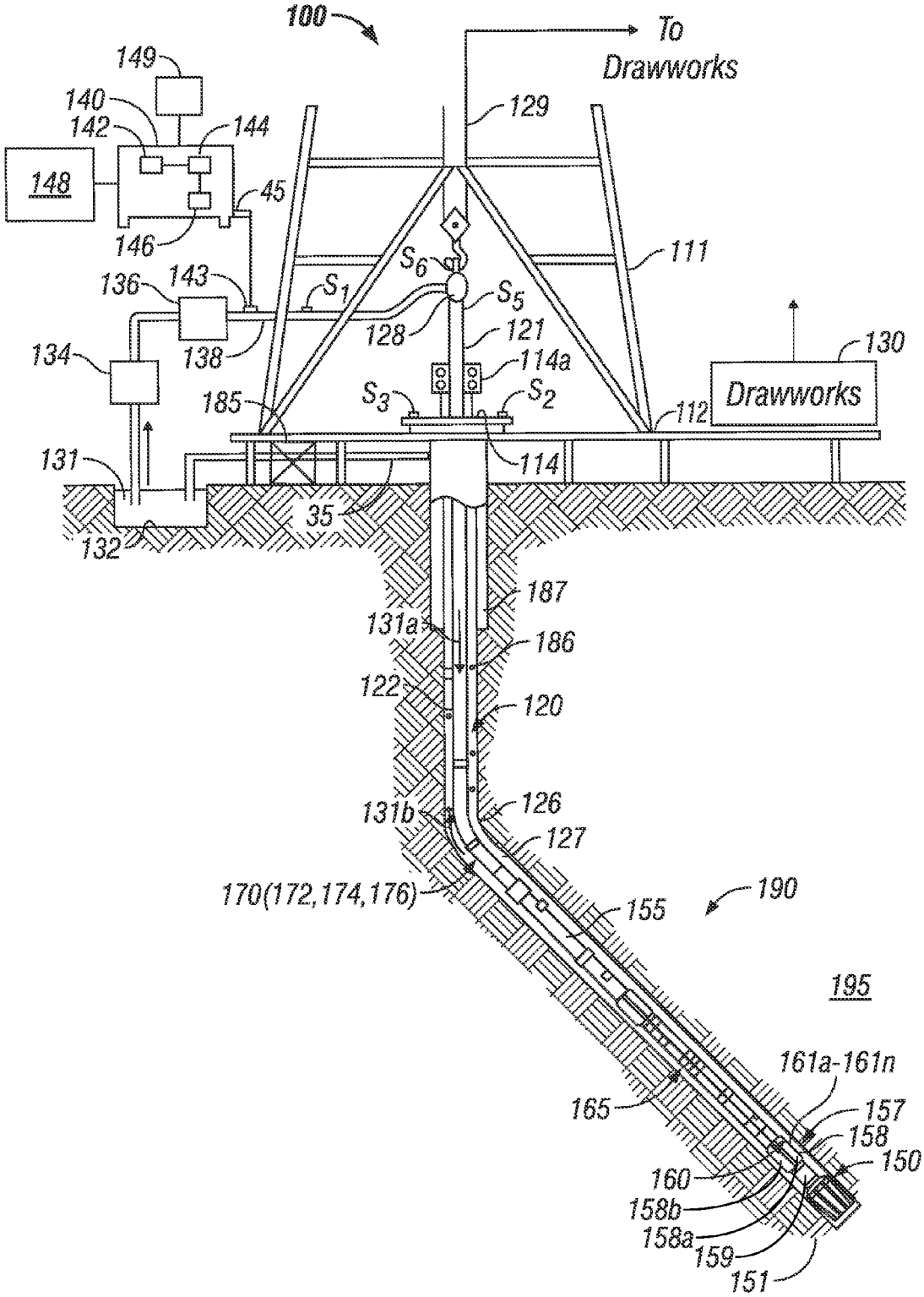
FIG. 1 is a schematic diagram of an exemplary drilling system that includes a bottomhole assembly that includes a steering unit or tool made according to one embodiment of the disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottom hole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190, attached at its bottom end extends from the surface to the bottom 151 of the borehole 126. A drill bit 150, attached to drilling assembly 190, disintegrates the geological formations when it is rotated to drill the borehole 26. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector **114*a* may be used to convey the coiled-tubing having the drilling assembly attached to its bottom end. The operations of the drawworks 130 and the tubing injector 114*a*** are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 respectively provide information about the torque and the rotational speed of the drill string 120. Tubing injection speed is determined from the sensor $S_5$, while the sensor $S_6$ provides the hook load of the drill string 120.

In some applications, the drill bit 150 is rotated by only rotating the drill pipe 122. However, in many other applications, a downhole motor 155 (mud motor) disposed in the drilling assembly 190 also rotates the drill bit 150. The ROP for a given BHA largely depends on the WOB or the thrust force on the drill bit 150 and its rotational speed.

The mud motor 155 is coupled to the drill bit 150 via a drive shaft disposed in a bearing assembly 157. The mud motor 155 rotates the drill bit 150 when the drilling fluid 131 passes through the mud motor 155 under pressure. The bearing assembly 157, in one aspect, supports the radial and axial forces of the drill bit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided to the surface control unit 140. The surface control unit 140 displays desired drilling parameters and other information on a display/monitor 148 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 149. The surface control unit 140 may process data relating to the drilling operations, data from the sensors and devices on the surface, data received from downhole, and may control one or more operations of the downhole and surface devices. Alternately, a downhole control unit 170 having a processor 172, storage device 174 and computer programs 176 may be used.

The BHA may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, properties or characteristics of the fluids downhole and other desired properties of the formation 195 surrounding the drilling assembly 190. Such sensors are generally known in the art and for convenience are generally denoted herein by numeral 165. The drilling assembly 190 may further include a variety of other sensors and devices 159 for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.) For convenience, all such sensors are denoted by numeral 159.

The drilling assembly 190 includes a steering apparatus or tool 158 for steering the drill bit 150 along a desired drilling path. In one aspect, the steering apparatus may include a steering unit 160, having a number of force application members 161*a*-161*n*, wherein the steering unit is at partially integrated into the drilling motor. In another embodiment the steering apparatus may include a steering unit 158 having a bent sub and a first steering device 158*a* to orient the bent sub in the wellbore and the second steering device 158*b* to maintain the bent sub along a selected drilling direction. Various exemplary embodiments of the steering apparatus are described in reference to FIGS. 2-7.

Figure 2:
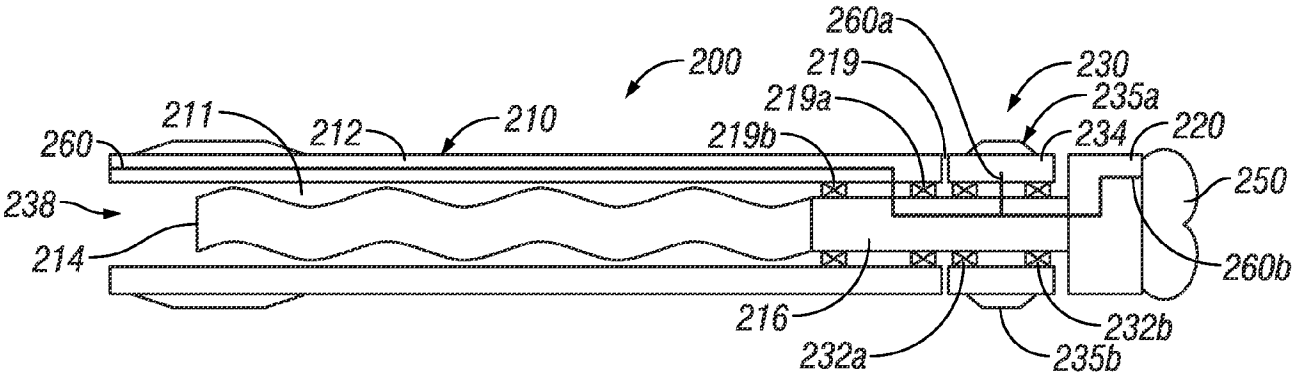
FIG. 2 is a schematic diagram of a steering unit integrated into a power section of a drilling motor, according to one embodiment of the disclosure.

FIG. 2 is a schematic diagram of an exemplary steering system or tool 200 that includes a steering unit 230 integrated into a power section 211 of a drilling motor 210, according to one embodiment of the disclosure. The drilling motor 210 includes a stator 212 and a rotor 214 in the stator 212. The rotor 214 is shown coupled to a shaft 216 (which may be a flexible shaft) terminating at a box end 220. The lower section 219 of the stator may be placed around the shaft 216 via bearings 219*a* and 219*b*. A drill bit 250 is connected into the box end 220. The steering unit 230 is configured to alter the direction of the drill bit 250 during drilling of a wellbore. In one configuration, the steering unit 230 may be placed around the shaft 216 via bearing 232*a* and 232*b*. The bearings 232*a* and 232*b* are configured to provide lateral (radial) and axial support to the steering unit 230. In this configuration, the steering unit 230 is placed between the drill bit 250 and the lower end 219 of the stator 212. The mud bearings 219*a*, 219*b*, 232*a* and 232*b* allow relative rotation of the sleeve 234 and the drill string (FIG. 1). In one aspect, the steering unit 230 may include a non-rotating or a substantially non-rotating sleeve 234 and a number of force application members, such as 235*a*, 235*b*, etc. (also referred to as deflection members or ribs) on the non-rotating sleeve 234. Each force application member (235*a*, 235*b*) may be independently operated to apply a selected amount of force on the wellbore wall to orient the drill bit 250 along a desired or selected direction.

In the steering system 200, drilling fluid 238 flowing through the drilling motor 210 lubricates the bearings 232*a*, 232*b*, 219*a* and 219*b*. These bearings may include PDC bearing elements. In one aspect, power and data communication between electrical components in the sleeve 234 may be provided by power and communication link 260 and 260*b* to the components in the non-rotating sleeve 234 and via links 260 and 260*b* to the drill bit 250.

Figure 3:
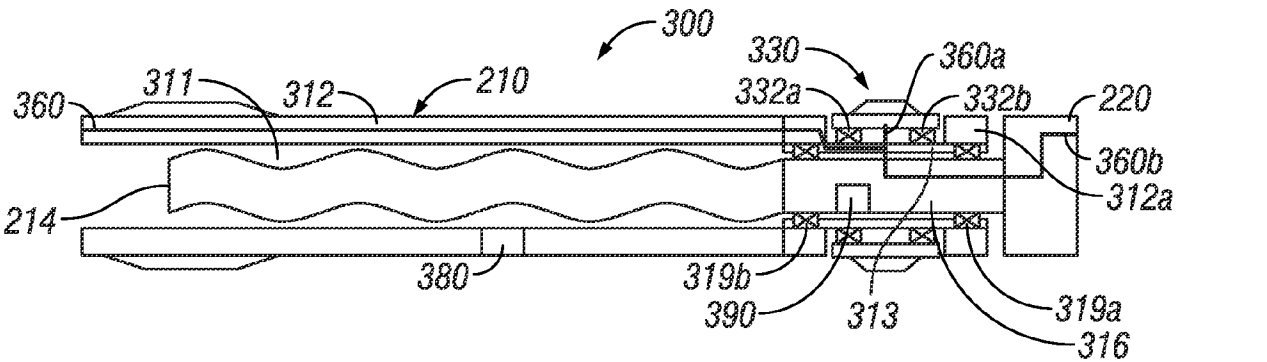
FIG. 3 is a schematic diagram of a steering unit integrated into a power section of a drilling motor, according to another embodiment of the disclosure.

FIG. 3 is a schematic line diagram of a steering system 300 integrated into the drilling motor 210, according to another embodiment of the disclosure. In the steering system 300, a lower section 312*a* of the stator 312 includes a recess 313. The lower section 312*a* is placed about the shaft 316 via bearings 319*a* and 319*b*. A non-rotating sleeve 330 is arranged with rotary bearings 332*a* and 332*b* about the recess 313. In one aspect, power and data communication may be provided to the components in the sleeve 330 via communication links 360 and 360*a* and to the drill bit 250 via links 360 and 360*b*. The configuration of the steering unit 330 provides optimized distribution of rotation speed and thus results in less stress and wear to the bearings 319*a*, 319*b*, 332*a* and 332*b*.

Figure 4:
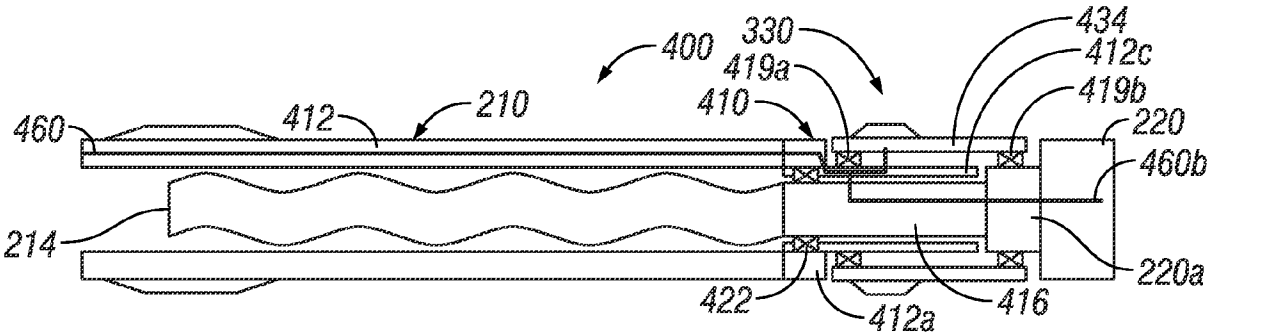
FIG. 4 is a schematic line diagram of a steering unit integrated into a power section of a drilling motor, according to yet another embodiment of the disclosure.

FIG. 4 is a schematic line diagram of a steering system 400 integrated into the drilling motor 210, according to yet another embodiment of the disclosure. In the steering system 400 a lower section 412*a* of the stator 412 has a recessed extension 412*c*. The box end 220 includes a lower diameter section 220*a*. The stator 412 is placed around the shaft 416 via a rotary bearing 422. The non-rotating sleeve 434 is disposed around the recess 412*c* via a radial bearing 419*a* placed on the recessed extension 412*c* and via a radial bearing 419*b* placed around the reduced diameter section 220*a* of the box end 220. In one aspect, power and data communication may be provided to the components in the non-rotating sleeve 434 via communication links 460 and 460*b* and to the drill bit 250 via communication links 460 and 460*b*. The configuration of the steering unit 400, in one aspect, may provide an optimized distribution of the rotation speed and thus reduces the stress and wear on the bearings 419*a*, 419*b* and 422.

Integrating the steering unit, such steering units 200, 300 and 400, into a drilling motor offers certain useful features. For example, with respect to steering units 300 and 400, the integration provides distribution of rotation speeds that may reduce the stress and wear of the bearings. Another feature may be the use of naturally present mud bypass flow from the motor section to cool the bearings for the non-rotating sleeves in steering units 230 and 430. In the steering systems 200, 300 and 400, less inert mass is rotated at the bit speed compared to some currently available steering systems. Such a reduction in the rotating mass can reduce the stresses and improve dynamics for mechanical and electronics components used in the steering system described herein. A hard-wired connection, such as link 260 through the stator 212, 312 and 412, eliminates the rotary bus typically used in the currently available system.

Still referring to FIGS. 2-4, the steering unit for altering the drilling direction may include a non-rotating sleeve and a number of force application members that independently exert selected force onto the wellbore wall to alter drilling direction. In one aspect, each force application member may be extended by supplying fluid under pressure to a piston that drives the force application member. A motor may be used to drive a pump to supply the fluid under pressure. Any other suitable mechanism may be utilized for the purposes of this disclosure. Power to the electrical components and data transfer between the components in the non-rotating sleeve may be provided using electrical couplings or by inductive coupling method or by any other suitable method. Such devices are known in the art and are thus not described in detail herein.

In other aspects, any number of suitable sensors may be disposed about the steering systems (200, 300, 400, 500) or at other suitable locations in the BHA or drill bit. Such sensors are individually and collectively referred to by numeral 380 when disposed in a non-rotating member and by 390 when disposed in a rotating portion of the various embodiments. Such sensors may include: an azimuthal gamma ray sensor in a rotating part of the steering system, a bit resistivity sensor comprising two toroids, both in a rotating part, both in the non-rotating sleeve, or one in a rotating part and the other in the non-rotating sleeve; an arrangement of sensors for taking MPR (multiple propagation resistivity) measurements, with one receiver placed close to the drill bit (in the sleeve or a rotary part) to achieve a look-ahead capability; a formation evaluation sensor using a transmitter and a receiver, wherein one of the transmitter and receiver is located in a rotating part and the other transmitter and receiver is located in a non-rotating section; a sensor for measuring rib extension to determine borehole diameter (caliper), tool deflection from the borehole centerline; sensors to determine torque-on-bit, weight-on-bit, bending moment, and dynamic movement of the BHA. Formation evaluation sensors may also be integrated into the steering unit, such as shallow reading resistivity sensors for measurements of the formation near the drill bit. Such measurements may be utilized to calibrate other tools in the BHA, such as resistivity imaging tools. In addition, any number of other sensors may be provided, such as accelerometers in a non-rotating part, magnetometers in a rotating part, a resolver or another reference indicator (such as sensors providing a trigger signal per revolution) to determine relative position of rotating and non-rotating parts. The accuracy of the results obtained from the sensors may be increased by utilizing three axis sensors. In addition, an algorithm may be utilized to provide redundancy or to replace measurements of a selected sensor with the measurements of another sensor in case of partial failure of such as sensor.

In other aspects, a friction wheel with an associated resolver pushed against the wellbore wall may be integrated in the non-rotating sleeve or integrated in one or more steering ribs. In yet another aspect, a friction ball with associated position measurement pushed against the wellbore wall (similar to a trackball for computers) may be integrated in the non-rotating sleeve or the ribs, or disposed in a rotating part of the BHA 190 (FIG. 1). Also, a dual arrangement of "roughness sensors" (needles contacting the borehole wall) may be integrated in the non-rotating sleeve or integrated in one or more steering ribs. Additionally, a dual arrangement of any formation evaluation sensor with sufficient spatial resolution and contrast to derive movement of the tool may be integrated in the non-rotating sleeve or integrated in one or more steering ribs or integrated in a rotating part of the BHA. In yet another aspect, the system described herein may also include an electrical and data coupling in the bit box to connect drill bits equipped with sensors and/or actuators to the BHA 190.

In another aspect, the drilling path may be controlled by utilizing one or more of: absolute azimuth and inclination measured in the steering tool; oriented bending moment at one or more positions inside the steering tool; rib expansion, rib force, or tool eccentricity; rate of change of azimuth and inclination; rate of penetration; torque, weight-on-bit; dynamic acceleration or vibration; a combination of measurements made in the steering tool with measurements made at other locations of the BHA. In other aspects, the inference of drilling path or other drilling parameters from the relative change of the two ("dual inclination") methods combined with steering tool and MWD tool measurements may be used to control drilling path. In particular, inclination, azimuth, and bending moments may be utilized for such a method.

Figure 5:
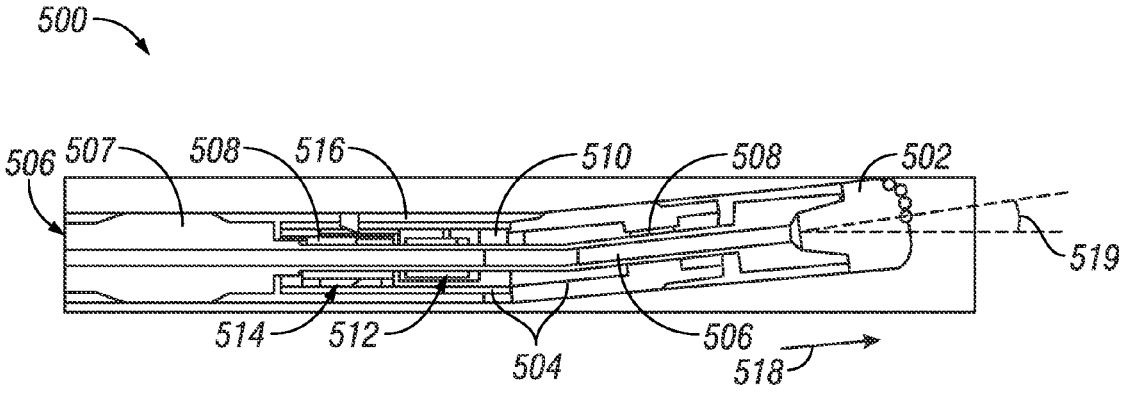
FIG. 5 is a schematic cross-sectional view of a steering unit that includes a bent housing and a first steering device for rotating the bent housing in the wellbore and a second steering device for maintaining the bent housing along a drilling direction, according to one embodiment of the disclosure.

FIG. 5 is a sectional view of a steering apparatus or tool 500 placed around a drill shaft 506 coupled to a drilling tubular (not shown) for steering a drill bit 502 during drilling of a wellbore 516. The steering tool 500 is a non-rotating or substantially non-rotating device disposed about the drill shaft 506. The drill shaft is rotated by rotating the drill string from the surface or by another mechanism. In aspects, the steering tool 500 includes a stationary deflection device (also referred to as the "bent sub" or "bent housing") 504 disposed around a drive shaft 506. The drive shaft 506 is shown to include a fluid flow path 509 for providing drilling fluid to the drill bit 502 and a stabilizer 507 for providing lateral or radial stability to the drive shaft 506 and the steering tool 500. The drive shaft 506 is coupled to a power source, such as a rotary table or a top drive (not shown) at the surface that rotates the drive shaft 506 to rotate the drill bit 502. Bearings 508 between the bent housing 504 and the drive shaft 506 support the bent housing 504 around the drive shaft 506 and enable rotation of the drive shaft 506. In aspects, the bent housing 504 may be composed of two sections, a straight section or housing 504*a* and bent section 504*b* coupled together by a bent coupling 510. In one aspect, the bent coupling 510 may be adjusted at the surface before conveying the drilling assembly into the wellbore 516 to set the angle (also referred to as kick off) of section 504*b*. The setting for the bent coupling 510 determines the angle of the bent housing 504 and drill bit 502 with respect to the axis of the drill string.

Still referring to FIG. 5, the steering tool 500, in one aspect, further includes an inner steering mechanism or device 512 configured to couple and decouple the drive shaft 506 and the housing 504 and an outer steering mechanism or device 514 configured to couple and decouple the steering unit to the inside wall of the wellbore 516. During drilling, the outer steering mechanism 514 engages the inside wall of the wellbore 516 to maintain the bent housing 504 along a selected or particular direction, while the inner steering mechanism 512 is inactive, i.e., not engaged to the shaft 506. To change the direction of the drill bit 502, the inner steering mechanism 512 is engaged to the bent housing 504, while the outer steering mechanism 514 is disengaged from the wellbore 516 wall. The shaft 506 is then rotated by rotating the drill string a selected amount from the surface or by another suitable mechanism. The shaft 506 is attached to the inner steering mechanism 512. Thus, when the inner steering mechanism 512 is actuated and coupled to the bent housing 504, rotation of the shaft 506 rotates the bent section 504*b* by the same amount as the drill shaft 506.

Thus, in steering tool configuration shown in FIG. 5, the drilling direction or turning radius of the drill bit 502 is defined by the angle 519 of the bent housing 504, while the outer steering mechanism 514 maintains the bent housing 504 stationary relative to the drill shaft 506 to control the drilling direction or path. The inner steering mechanism 512 enables rotation of the bent housing 504 along with the shaft 506 while the steering tool 500 is in the wellbore 516. Thus, rotation (or azimuthal direction) of the bent housing 504 is controlled by selectively coupling and decoupling the inner steering mechanism 512 to the bent housing 504 and rotating the shaft 506 to set the angle (or azimuth) of the bent housing 504 about the drill string axis. Therefore, once the bent housing angle is set at the surface, the angle between the drill bit 502 and the drill string axis remains constant. However, the direction (or azimuth) in which the bent housing 504 is oriented relative to the drill string axis may be changed without removing the drill string from the wellbore 516 by selectively coupling and decoupling the inner steering mechanisms 512 to the bent housing 504 while selectively coupling and decoupling the outer steering mechanisms 514 from the wellbore 516 and rotating the drill string by a desired amount.

Figure 6:
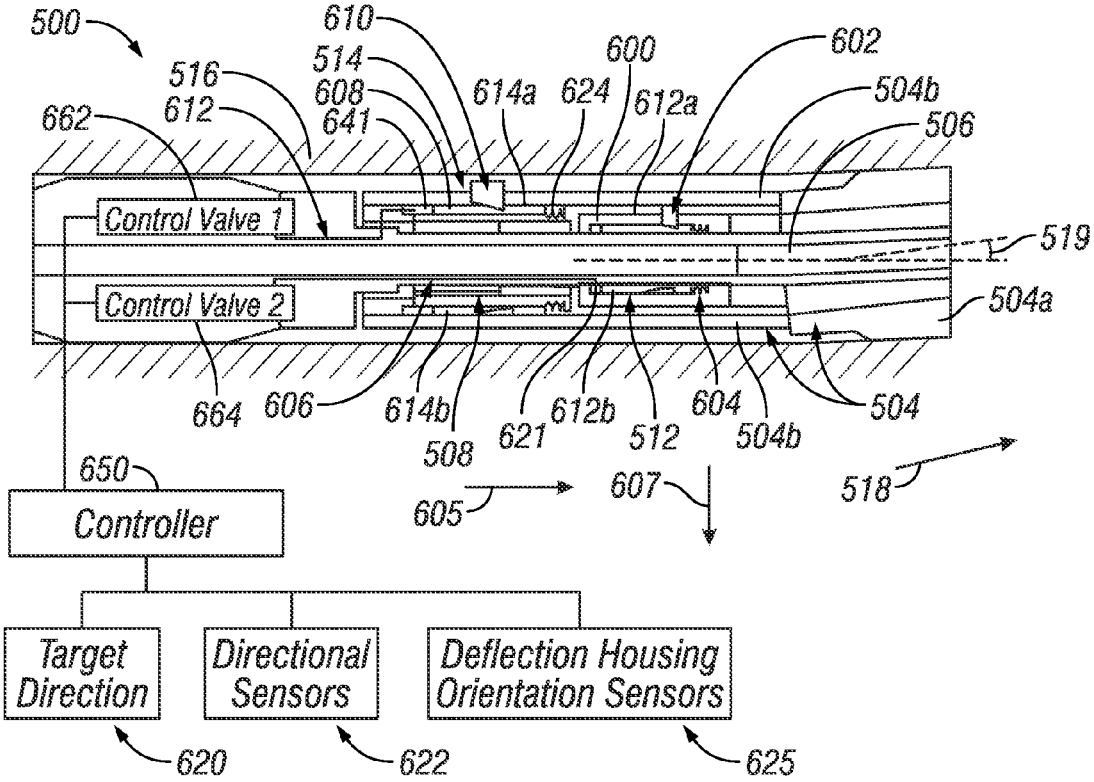
FIG. 6 is a schematic cross-sectional view of a steering unit with a bent housing of FIG. 5 when the first steering device is engaged to the bent housing.

FIG. 6 is a sectional view of the steering tool 500 shown in FIG. 5, depicting details of the certain components of the steering tool 500. In aspects, the inner steering mechanism 512 includes one or more steering devices coupled to and located on the shaft 506. FIG. 6 shows two inner steering devices 612*a* and 612*b*. In practice, the steering mechanism 512 may include three or more such devices. The operation of the steering mechanism is described in reference to device 612*a*. In one configuration, the steering device 612*a* may include a piston or actuator 600, such as sliding actuator or sleeve, a coupling member 602, such as a clamping pad or rib, a biasing member 604, such as a spring, and a control line 606. In the particular configuration 612*b* of the device, the sliding actuator is shown to be a sliding sleeve with a wedge shaped section 631 and the clamping pad 600 is shown disposed on the sliding sleeve. The clamping pad 600 includes a wedge-shaped section sloped in a direction opposite to the direction of the slope of the wedge-shaped section of the sliding sleeve 608. The inner steering mechanism 512 components are secured in a section of the non-rotating steering tool 500. In an aspect, to rotate the bent housing 504*b* in the wellbore, the drill string is not rotated causing the shaft 506 to be non-rotating so that the inner mechanism 512 may be coupled to or engaged with the bent housing 504. To engage or couple the device 612*a* to the bent housing 504, hydraulic power (fluid under pressure) may be supplied into a pressure chamber 621, which moves the sliding actuator 600 in an axial direction 605, compressing the biasing member 604 and pushing the coupling member 602 outwardly in a radial direction 607. When the coupling member is retracted, the biasing member 604 holds the sliding actuator 600 in position and thus the coupling member 606. The coupling member 606 moves radially to apply force on the bent housing 504, thereby creating friction between the bent housing 504 and the coupling member 602. Similarly, the device 612*b* and any other such devices are activated to create friction between the bent housing 504 and the coupling member 602.

In aspects, all steering devices 612*a*, 612*b*, etc. may be activated to apply equal or substantially equal force substantially simultaneously to create substantially equal friction between the coupling member 602 and the inner wall of the bent housing 504. Activating the inner steering mechanism causes the coupling member 602 to hold the shaft 506 and the bent housing 504*b* stationary relative to each other. The shaft 506 may then be rotated by a selected amount by rotating the drill string. Rotating the shaft rotates the bent housing 504 by the same amount. Once the bent housing 504*b* has been rotated a desired amount, the fluid pressure on the actuator 600 is released, which causes the biasing member 604 to move the actuator 600 to its original position, which in turn causes the coupling member 602 to retract. When retracted, the coupling member 602 disengages from contact with the bent housing 504. The above procedure allows the bent section 504*b* to be oriented in a new direction. The drilling may then be resumed with the bent housing 504 and drill bit 502 at the new orientation.

Still referring to FIG. 6, the outer steering mechanism 514 includes one or more steering devices. FIG. 6 is shown to include two steering devices 614*a* and 614*b*. In practice, the steering mechanism 514 may include three or more steering devices. The operation of the steering mechanism 514 is described in reference to steering device 614*a*. In one configuration, the steering device 614*a* may include an actuator 608, such as a sliding actuator or sleeve, a coupling member 610, such as a clamping pad or rib, a biasing member 614, such as a spring and a control line 612. In the particular configuration of the device 614*a*, the sliding actuator 608 is shown to include a wedge-shaped section 641 and the clamping pad 610 is shown disposed on the sliding sleeve 608. The clamping pad 610 includes a wedge-shaped section sloped in a direction opposite the direction of the slope of the wedge-shaped section of the sliding sleeve 608. The inner steering mechanism 512 components are secured in a section of the non-rotating steering tool 500.

As noted earlier, the outer steering mechanism 514 is engaged or coupled to the wall of the wellbore 516 so that the non-rotating steering tool 500, including the bent housing 504*a* will remain substantially stationary relative to the drive shaft 506, while allowing travel along the axis of borehole elongation. To engage or couple the device 614*a* to the wellbore 516, hydraulic power (fluid under pressure) is supplied into a pressure chamber 641, which moves the sliding actuator 608 in the axial direction 605, compressing the biasing member 624 and pushing the coupling member 610 outwardly in the radial direction 607. The biasing member 624 holds the sliding actuator 608 in position and thus the coupling member 610. The coupling member 610 moves radially to apply force on the wall of the wellbore 516, thereby creating friction between the coupling member 610 and the wall of the wellbore 516. Similarly, the device 614*b* and any other such devices are activated to create friction between the coupling member 610 and the wellbore wall. In aspects all steering devices 614*a*, 614*b*, etc. are activated to apply equal or substantially equal force substantially simultaneously to create substantially equal friction around the wellbore 516. Activating the outer steering mechanism causes the steering tool 500 to be held radially stationary, but also allows it to slide along the wellbore 516 during drilling, thereby enabling the bent housing 504*b* to maintain its orientation.

In one aspect, the steering tool 500 includes a controller 650 configured to activate and deactivate the inner and outer steering mechanisms. In one configuration, the controller 650 controls a control valve 662 to supply a fluid, which in one aspect may be drilling fluid, to the pressure chamber 641 to activate the coupling members 610 to engage the wellbore wall. The controller 650 also controls a valve 664 to control fluid to the pressure chamber 621 to activate the coupling member 602. In this particular configuration, fluid from the rotating member is supplied to the non-rotating steering devices 512 and 514, thus avoiding the use of any electronic components in the non-rotating steering tool. Alternatively, fluid under pressure may be supplied from a reservoir in the non-rotating steering tool by a motor and a pump (not shown). The controller 650 may be located in the BHA or a suitable location in the steering tool 500. The controller 650 may include a processor that activates the supply of the fluid to the coupling members 610 according to instructions stored in a computer-readable medium, such a solid state memory. The instructions may include a target direction 620, data from directional sensors 622 and/or data from deflection housing orientation sensors 625. Alternatively, or in addition to, the instructions may be provided from a controller at the surface.

Figure 7:
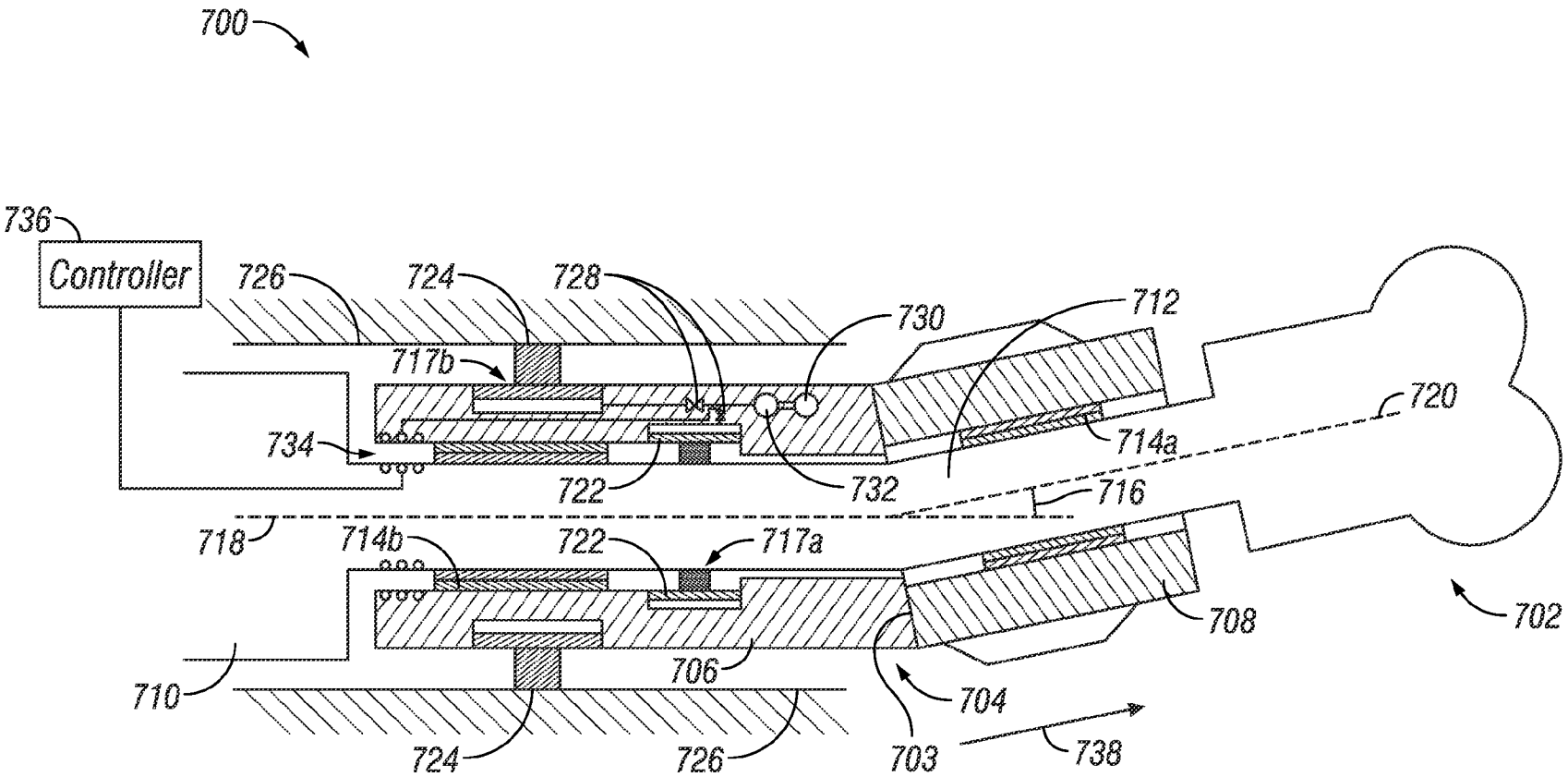
FIG. 7 is a schematic cross-sectional view of a steering unit with a bent housing, according another embodiment of the disclosure.

FIG. 7 is a sectional view of an exemplary steering apparatus or tool 700 coupled to a drilling tubular (not shown) for steering a drill bit 702, according to another embodiment of the disclosure. The steering apparatus 700 may be used for directional drilling in a formation. As noted earlier, drill bit 702 may be any suitable type of drill bit, including, but not limited to, a PDC bit and a roller cone bit. A drive shaft 710 coupled to the drill bit 702 rotates the drill bit 702 during drilling of a wellbore 726. The steering apparatus 700 includes a steering unit or device 704 coupled to a bent sub 708. In one aspect, the steering unit is substantially non-rotating and disposed around a drill shaft 710. The steering device 704 is substantially parallel to a drill string axis 718. The bent sub 708 may be positioned at a steering angle 716 with respect to the drill string axis 718 to steer the drill bit 720 along a selected direction (or azimuth) within the formation 726. The angle 716 may be fixed or set at a selected value by positioning a rigid coupling 703 between a non-rotating housing 706 and the bent sub 708. The angle 716 may be set at the surface before deploying the drill string in the wellbore. The steering device 704 includes a non-rotating housing 706 coupled to the bent sub 708. Bearings 714*a* may be placed to support the bent sub 708 around the drive shaft 710 and bearings 714*b* may be placed to support the housing 706 around the shaft 710. As depicted, an angled centerline 720 located in the center of the drill bit 702 indicates the direction of steering of the drill bit 702.

In one aspect, the steering unit 704 is non-rotating or substantially non-rotating and may be disposed in a recess 711 in the drive shaft 712. In one aspect, the steering unit 704 includes inner steering device 717*a* having one or more inner force application members 722 that may be actuated or moved to couple and decouple the steering unit 704 to the drive shaft 710. The steering unit 704 may also include an outer steering device 717*b* having one or more outer force application members 724 that may be actuated to couple and decouple the housing steering unit 704 to the wellbore wall 726. The actuation of force application members 722 and 724 may be powered and controlled by any suitable system, including, but not limited to, an electrical system, an electromechanical system and a fluid powered or hydraulic system. In an aspect, a hydraulic control system may include a pair of valves 728, motor 730, and pump 732. The system components may be used to independently control actuation of the force application members 722 and 724. In one aspect, components of the steering unit 704 may be provided with electrical power and data communication via a suitable coupling mechanism, such as an inductive coupling 734. A controller 736 located in the drill string and/or at the surface may be utilized to control the operation of the force application members 722 and 724. The controller 736 may include a processor, memory and programs configured to control the operation and drilling direction 738 of the drill bit 702.

The controller 736 and hydraulic control system may alter the drilling direction 738 by selectively coupling and decoupling the steering unit 704 to the drive shaft 710 and the wellbore wall 726. In one embodiment, the inner force application members 722 extend to couple the steering unit 704 to the drive shaft 710 to orient the bent sub 708 and thus the drill bit 702 in the desired direction within the wellbore. To change orientation of the bent sub 708 within the wellbore, the inner force application members are coupled to the drive shaft 710 and the outer force application members 724 are decoupled from the wellbore wall 726. The bent sub may then be reoriented to any selected position by rotating the drill shaft 710. When the bent sub 708 and hence the drill bit 702 are at the desired steering angle, the inner force application members 722 are decoupled from the drive shaft 710. Accordingly, the drive shaft 710 freely rotates within the housing 704 to drive the drill bit 702 in the direction 738. To drill the wellbore at the selected bent sub orientation, the outer force application members may be engaged to the wellbore 726 to maintain the bent housing substantially radially stationary relative to the wellbore inside and substantially free to move along the axial direction, i.e., along the curved drilling direction.

Still referring to FIG. 7, the actuation of the force application members 722 and 724 may be controlled and powered by the drilling mud pumped from the surface and/or an electrical circuit and associated fluid within the steering unit 704. The force application members 722 and 724 may be composed of any suitable durable material and size that will cause sufficient friction between the member 722 and the drive shaft 710, and between the member 724 and the wellbore wall 726 respectively. Further, the force application members 722 and 724 may be any suitable shape and orientation to provide surface contact for a coupling to the drive shaft 710 and the wellbore wall 726. In an embodiment, there may be as few as one or as many as six outer steering members 724 located in the housing 704. Further, an embodiment may also include one to six inner steering members 726. In another aspect, any other suitable devices for providing friction between the non-rotating members and the drill shaft and the wellbore may be utilized, including, but not limited to expandable packers.

While the foregoing disclosure is directed to the certain exemplary embodiments and methods, various modifications will be apparent to those skilled in the art. It is intended that all modifications within the scope of the appended claims be embraced by the foregoing disclosure.

The invention claimed is:

1. An apparatus for use in a wellbore, comprising:

a drilling motor including a rotor inside a stator; and a steering unit including a sleeve and a shaft, wherein a section of the stator is placed around the shaft to at least partially integrate the steering unit into the drilling motor.

2. The apparatus of claim 1, wherein:

a lower section of the stator encloses a portion of the shaft configured to rotate a drill bit; and the sleeve of the steering unit is a substantially non-rotating member placed around the shaft between the lower section of the stator and the drill bit and wherein the steering unit further includes:

a force application member on the non-rotating member configured to extend from the non-rotating member to apply force the wellbore.

3. The apparatus of claim 2, wherein the shaft is supported by the lower section of the stator and the non-rotating member is supported by the shaft.

4. The apparatus of claim 1, wherein the steering unit includes a substantially non-rotating member that is at least partly integrated into a recessed section in the stator.

5. The apparatus of claim 4, wherein the non-rotating member of the steering unit is placed around the recessed section in the stator.

6. The apparatus of claim 5 further comprising a first bearing supporting the recessed section in the stator on the shaft coupled to the rotor and a second bearing supporting the non-rotating member on the recessed section of the stator.

7. The apparatus of claim 1, wherein a non-rotating member of the steering unit is partly placed in a recessed section of the stator and partly on a shaft coupled to the rotor of the drilling motor.

8. The apparatus of claim 1, wherein:

the drilling motor includes a stator having a recessed section and a rotor inside the stator that rotates the shaft and wherein the non-rotating member of the steering unit is placed in the recessed section of the stator and the recessed section is supported on the shaft.

9. The apparatus of claim 1 further comprising a communication link in the stator configured to provide power to one of: the steering unit; and a drill bit coupled to the rotor via shaft.

10. The apparatus of claim 9, wherein the communication link includes one of: (i) an electrical contact device coupled to the shaft and the steering unit; (ii) an inductive coupling between the steering unit and a rotating member of the drilling motor; and (iii) a fluid line between the steering unit and a rotating member of the drilling motor.

11. An apparatus for use in wellbore, comprising:

a rotating member configured to rotate a drill bit;

a steering member placed outside the rotating member, the steering member including a selected orientation;

a first steering device configured to orient the steering member when the steering member is in the wellbore; and a second steering device configured to maintain orientation of the steering member when drilling the wellbore.

12. The apparatus of claim 11, wherein the steering member is a bent housing coupled to the second steering device.

13. The apparatus of claim 12, wherein the first steering device, second steering device and the steering member are non-rotating relative to the wellbore during drilling of the wellbore.

14. The apparatus claim 11, wherein the first steering device is configured be coupled to the rotating member so that rotation of the rotating member rotates the steering member.

15. The apparatus of claim 11, wherein the first steering device is configured to rotate with the rotating member.

16. The apparatus of claim 11, wherein the second steering member is decoupled from the rotating member.

17. The apparatus of claim 11, wherein the first steering device includes one or more force application members that extend from their respective retracted positions to cause friction between the first steering device and the rotating member.

18. The apparatus claim 11, wherein the second steering device is configured to create friction between the second steering device and the wellbore sufficient to maintain orientation of the steering member in the wellbore while drilling the wellbore.

19. The apparatus of claim 11, wherein when the first steering device is coupled to the rotating member and the second steering device is coupled to the wellbore, the steering member orients from a first position to a second position during drilling of the wellbore.

20. The apparatus of claim 11, wherein angle of the steering member is adjustable at the surface.

* * * * *